United States Patent [19]

Kawaguchi et al.

[11] 4,418,141

[45] Nov. 29, 1983

[54] PHOTOGRAPHIC LIGHT-SENSITIVE MATERIALS

[75] Inventors: Hideo Kawaguchi, Minami-ashigara; Takayuki Inayama, Fujinomiya, both of Japan

[73] Assignee: Fuji Photo Film Co., Ltd., Kanagawa, Japan

[21] Appl. No.: 333,347

[22] Filed: Dec. 22, 1981

[30] Foreign Application Priority Data

Dec. 23, 1980 [JP] Japan ..... 55-182613

[51] Int. Cl.[3] ..... G03C 1/78

[52] U.S. Cl. ..... 430/530; 430/527; 430/961

[58] Field of Search ..... 430/527, 530, 961

[56] References Cited

U.S. PATENT DOCUMENTS

| | | | |
|---|---|---|---|
| 3,245,833 | 4/1966 | Trevoy | 430/271 |
| 3,503,743 | 3/1970 | Kosar | 430/531 |
| 3,874,879 | 4/1975 | Rasch | 430/530 |
| 4,078,935 | 3/1978 | Nakagiri et al. | 430/527 |
| 4,264,707 | 4/1981 | Uozumi et al. | 430/530 |
| 4,267,266 | 5/1981 | Shibue et al. | 430/530 |

*Primary Examiner*—J. Travis Brown

*Attorney, Agent, or Firm*—Sughrue, Mion, Zinn, Macpeak & Seas

[57] ABSTRACT

A photographic light-sensitive material having improved antistatic properties is described, comprising a plastic support, at least one photographic light-sensitive emulsion layer on one side of the support, and an antistatic layer on the other side of the support, wherein the antistatic layer contains fine particles of at least one crystalline metal oxide selected from ZnO, $TiO_2$, $SnO_2$, $Al_2O_3$, $In_2O_3$, $SiO_2$, MgO, BaO, and $MoO_3$, or a composite oxide thereof.

16 Claims, No Drawings

PHOTOGRAPHIC LIGHT-SENSITIVE MATERIALS

FIELD OF THE INVENTION

The present invention relates to photographic light-sensitive materials (hereinafter referred to merely as "light-sensitive materials"), and more particularly, to light-sensitive materials having improved antistatic properties.

BACKGROUND OF THE INVENTION

Light-sensitive materials are generally prepared by coating a photographic light-sensitive emulsion layer (hereinafter referred to simply as a "light-sensitive layer"), an antihalation layer, a protective layer, an intermediate layer, a subbing layer, a backing layer (hereinafter referred to simply as a "back layer"), and so forth on an insulative plastic film support.

In recent years, techniques for production of light-sensitive materials have been markedly improved; for example, coating speeds for each layer and cutting speeds of light-sensitive material have been greatly increased.

Also, handling speed of light-sensitive material during photographing and transportation speed of light-sensitive material during development processing have been greatly increased.

During the production of light-sensitive materials or in the use thereof, therefore, contact friction and peeling-apart of the light-sensitive materials with itself, or between the light-sensitive materials and other materials readily occur, tending to cause the generation of static electricity.

As is well known, the generation of static electricity in light-sensitive material leads to attachment of dust, etc., onto the light-sensitive material, resulting in the occurrence of various problems, and when the generation of static electricity is vigorous, spark discharge can occur, causing the formation of so-called static marks, which is a critical problem.

Heretofore, as antistatic agents for use in a back layer, polymeric electrolytes or surface active agents have been often employed. However, the effect of these polymeric electrolytes or surface active agents in reducing the generation of static electricity greatly varies depending on humidity; that is, at high humidities, electrical conductivity is obtained to the extent that the intended objects can be attained, whereas at low humidities, the electrical conductivity may be significantly reduced. Furthermore, when allowed to stand in the state that it is superposed on the light-sensitive layer, such as when coiled in a roll, the back layer absorbs moisture and adheres to the surface of the light-sensitive layer, causing a problem of adhesion.

Furthermore, polymeric electrolytes and low molecular weight surface active agents are generally water-soluble, and therefore, during development processing, they are dissolved in the processing solutions, and may combine together with other substances contained in the processing solutions to cause the formation of turbidity and sludge, or they may cause other substances to be absorbed onto the back layer, forming uneveness.

In order to solve the problem of adhesion, a method has been employed in which colloids of non-crystalline inorganic oxides are used. In accordance with this method, however, when inorganic oxide colloid sols are used, the antistatic properties deteriorate after development. Furthermore, this method fails to improve sufficiently the dependence of antistatic properties on humidity.

In addition, a method has been proposed in which a carbon black dispersion layer is provided for both antihalation and prevention of the generation of static electricity. This carbon black layer, however, is removed during development processing, and thus after development the antistatic properties are lost.

SUMMARY OF THE INVENTION

An object of the present invention is to provide light-sensitive materials having excellent antistatic properties.

Another object of the present invention is to provide light-sensitive materials having antistatic properties which are not affected by changes in humidity.

A further object of the present invention is to provide light-sensitive materials provided with an antistatic layer which causes no adhesion to an adjacent layer surface even at high humidity.

Still another object of the present invention is to provide light-sensitive materials provided with an antistatic layer containing antistatic agents which do not dissolve in development processing solutions, and which, therefore, is free from the formation of turbidity and sludges due to the dissolution of antistatic agents.

Still another object of the present invention is to provide light-sensitive materials having an antistatic layer whose effect of reducing the generation of static electricity is not reduced by development processing.

The present invention, therefore, is a photographic light-sensitive material comprising a plastic film support, at least one light-sensitive layer on one side of the support, and an antistatic layer on the other side of the support, wherein the antistatic layer contains fine particles of at least one crystalline metal oxide selected from the group consisting of ZnO, $TiO_2$, $SnO_2$, $Al_2O_3$, $In_2O_3$, $SiO_2$, MgO, BaO, and $MoO_3$, or a composite oxide thereof.

DETAILED DESCRIPTION OF THE INVENTION

Fine particles of crystalline metal oxide or its composite oxide as used herein have a volume resistivity of $10^7$ Ω.cm or less, and preferably $10^5$ Ω.cm or less. The grain size (i.e., largest cross-sectional dimension) is typically from 0.01 to 0.7μ, and preferably from 0.02 to 0.5μ.

These fine particles can be prepared by various methods, as described in detail, for example, in Japanese Patent Application (OPI) No. 143430/81 (the term "OPI" as used herein refers to a "published unexamined Japanese patent application") (which corresponds to U.S. patent application Ser. No. 253,499, filed on Apr. 13, 1981). Typical examples of such methods of production of fine particles are (1) a method in which fine metal oxide particles are prepared by burning, and then are heat-treated in the presence of different atoms (dopants) to increase electrical conductivity, (2) a method in which the production of fine metal oxide particles by burning as in (1) is performed in the presence of the dopants to increase electrical conductivity, and (3) in the production of fine metal oxide particles by burning as in (1), the concentration of oxygen in the atmosphere is lowered to introduce "oxygen defects" in the crystal structure.

Examples of dopants for use in the methods (1) and (2) above include Al and In for ZnO; Nb and Ta for $TiO_2$; and Sb, Nb, and halogen elements for $SnO_2$. In general, a combination of a metal oxide and a dopant which has one lower or higher valence than that of the metal of said metal oxide (e.g., a combination of ZnO ($Zn^{2+}$) and Al ($Al^{+3}$) and a combination of SnO ($Sn^{4+}$) and Sb ($Sb^{3+}$ or $Sb^{+5}$)) is preferred. The amount of the dopant added is preferably from 0.01 to 30 mol % and particularly preferably from 0.1 to 10 mol %.

The amount of the conductive particle used is preferably from 0.05 to 20 g/m$^2$, and particularly preferably from 0.1 to 10 g/m$^2$.

Binders for fine particles which can be used in providing an electrically conductive layer according to the invention include cellulose esters, such as cellulose nitrate, cellulose triacetate, cellulose diacetate, cellulose acetate butyrate, and cellulose acetate propionate; homo- and copolymers of vinylidene chloride, vinyl chloride, styrene, acrylonitrile, vinyl acetate, alkyl acrylate, vinyl pyrrolidone, or the like; soluble polyesters; polycarbonates; and soluble polyamides. In dispersing the fine particles, dispersing solutions, such as those including titanium- or silane-based dispersants, may be added. In addition, binder cross-linking agents, surface active agents, and electrolytes (e.g., sodium phosphate) may be added.

Examples of titanium-based dispersants are titanate-based coupling agents as described in U.S. Pat. Nos. 4,069,192, 4,080,353, etc., and Plenact (trademark for product of Ajinomoto Co., Inc.). Examples of silane-based dispersants are vinyltrichlorosilane, vinyltriethoxysilane, vinyltris($\beta$-methoxyethoxy)silane, $\gamma$-glycidoxypropyltrimethoxysilane, and $\gamma$-methacryloxylpropyltrimethoxysilane. These compounds ae commercially available as "silane coupling agents", for example, from Shin-Etsu Chemical Industries, Ltd.

Binder cross-linking agents which can be used include epoxy-based, isocyanate-based, isothiocyanate-based, and aziridine-based cross-linking agents.

In order to provide electrical conductivity, the electrically conductive fine particles may be dispersed in a binder and provided on a support, or after application of a subbing treatment on the support, a dispersion of electrically conductive fine particles in a binder may be applied thereon.

Supports which can be used include cellulose triacetate, cellulose acetate butyrate, cellulose acetate propionate, polyethylene terephthalate, polyethylene naphthalate, polycarbonate, polystyrene, polyethylene- or polypropylene-coated paper, and the like.

In the invention, it is preferred that a hydrophobic polymer layer is additionally provided on the electrically conductive layer.

The hydrophobic polymer layer which is to be provided on the electrically conductive layer in the invention can be prepared by coating a hydrophobic polymer in the form of a solution inan organic solvent, or an aqueous latex. The amount of the hydrophobic polymer coated is preferably about 0.05 to 1 g/m$^2$ as a dry weight.

Hydrophobic polymers which can be used include cellulose esters, such as nitrocellulose and cellulose acetate; vinyl-based polymers, such as polyvinyl chloride, polyvinylidene chloride, and polyvinyl acrylate; and organic solvent-soluble polyamides and polyesters.

To the hydrophobic polymer layer may be added lubricants, e.g., organic carboxylic acid amides as described in Japanese Patent Application (OPI) No. 79435/80, in order to provide lubricating properties. Also, matting agents may be added thereto.

Coating of the electrically conductive layer and hydrophobic polymer layer can be performed by conventional techniques, such as roller coating, air knife coating, gravure coating, bar coating, and curtain coating.

The light-sensitive material of the invention may include, if necessary, a subbing layer, an anti-halation layer, an intermediate layer, and a surface protective layer, in addition to at least one light-sensitive layer, on the light-sensitive layer side of the support.

The subbing layer is used herein can be prepared using vinylidene chloride-based copolymers as described, for example, in Japanese Patent Application (OPI) No. 135526/76, and U.S. Pat. Nos. 3,143,421, 3,586,508, 2,698,235, and 3,567,452, diolefin (e.g., butadiene)-based copolymers as described, for example, in Japanese patent application (OPI) No. 114120/76 and U.S. Pat. No. 3,615,556, glycidyl acrylate- or glycidyl methacrylate-containing copolymers as described, for example, in Japanese Patent Application (OPI) No. 58469/76, polyamide-epichlorohydrin resins as described, for example, in Japanese Patent Application (OPI) No. 24923/73, maleic anhydride-containing copolymers as described in Japanese Patent Application (OPI) No. 39536/75, and the like.

A preferred example of a light-sensitive layer is a silver halide emulsuion layer. Examples of useful silver halides include silver chloride, silver chlorobromide, silver iodobromide, and silver chloroiodobromide.

Various additives which are normally used in photographic emulsions, for example, chemical sensitizers, anti-foggants, surface active agents, protective colloids, hardeners, polymer latexes, color couplers, matting agents, and sensitizing dyes, can also be added, for example, by reference to *Research Disclosure,* Vol. 176, pp. 22–28 (Dec. 1978).

The intermediate layer, antihalation layer, and surface protective layer are also subject to no special limitations, and can be prepared using various additives as described, for example, in the above noted *Research Disclosure* publication.

The method for production of photographic emulsions and a method of coating various photographic layers on the support are also subject to no special limitations, and can be performed, for example, by reference to the above noted *Research Disclosure* publication.

A light-sensitive material according to the invention can be used, for example, in the form of a color negative film, a color reversal film, and a black-and-white photographic film.

The following examples are provided to illustrate the invention in greater detail.

EXAMPLE 1

A mixture of 65 parts by weight of stannic chloride hydrate and 1.5 parts by weight of antimony trichloride was dissolved in 1,000 parts by weight of ethanol to prepare a uniform solution. Then, a 1 N aqueous solution of sodium hydroxide was added dropwise to the uniform solution until the pH of the resulting solution reached 3, to thus prepare a coprecipitate of colloidal stannic oxide and antimony oxide. The thus-obtained coprecipitate was allowed to stant at 50° C. for 24 hours to obtain a red-brown colloidal precipitate.

The red-brown colloidal precipitate was separated by centrifugal separation. In order to remove excessive ions (i.e., chloride ion), water was added to the precipitate and centrifugal separation was performed. This procedure was repeated three times to remove the excessive ions.

To 1,000 parts by weight of water was added 100 parts by weight of the colloidal precipitate from which the excessive ions had been removed. The mixture was sprayed into a burning furnace maintained at 650° C. to obtain fine bluish particles having an average grain size of 0.15μ (i.e., largest cross-sectional dimension).

A mixture having the formulation shown below was dispersed for 5 hours by the use of a paint shaker (produced by Toyo Seizai Seisakujo) to obtain a dispersion.

| | Parts by weight |
|---|---|
| Electrically conductive fine particles | 200 |
| Salane F-310 (vinylidene chloride-based copolymer, produced by Asahi Dow Co., Ltd.) | 10 |
| Methyl ethyl ketone | 150 |

Using the thus-prepared dispersion, a coating solution having the formulation shown below was prepared.

| | Parts by weight |
|---|---|
| Dispersion | 15 |
| Salane F-310 | 3 |
| Methyl ethyl ketone (MEK) | 100 |
| Cyclohexanone | 20 |
| m-Cresol | 5 |

The coating solution thus-prepared was coated on a 100μ thick polyethylene terephthalate film in a dry coating weight of 1.3 g/m$^2$ and dried at 130° C. for 2 minutes.

On the thus-prepared layer was further coated a coating solution having the formulation shown below in a dry coating amount of 0.2 g/m$^2$, and dried at 130° C. for 1 minute.

| | Parts by weight |
|---|---|
| Cellulose triacetate | 1 |
| Methylene dichloride | 60 |
| Ethylene dichloride | 40 |
| Erucic acid amide | 0.001 |

The thus-prepared layer is hereinafter referred to as the back layer.

On the opposite side of the support was coated a conventional silver halide emulsion for microphotography, after first applying a snubbing layer.

The surface resistance of the back layer as determined with an insulation resistance-measuring apparatus (Model VE-30, produced by Kawaguchi Denki Co., Ltd.) was $7\times10^8$ Ω at 25° C. and 25% RH. When the back layer was brought into contact with the photographic emulsion layer, and was allowed to stand under a load of 2 kg/10 cm$^2$ at 50° C. and 80% RH for 12 hours, no adhesion occurred.

EXAMPLE 2

A dispersion of electrically conductive fine particles was prepared in the same manner as in Example 1.

Using the thus-prepared dispersion, a coating soluton having the formulation shown below was prepared.

| | Parts by weight |
|---|---|
| Dispersion | 15 |
| Salane F-310 | 3 |
| MEK | 70 |
| Methanol | 30 |
| Cyclohexanone | 20 |

The coating solution thus-prepared was coated on a 140μ thick cellulose triacetate film support in a dry coating amount of 2 g/m$^2$, and dried at 120° C. for 3 minutes.

On the thus-prepared layer was further coated a coating solution having a formulation shown below in a dry coating amount of 0.3 g/m$^2$, and dried at 120° C. for 2 minutes.

| | Parts by weight |
|---|---|
| Cellulose diacetate | 10 |
| Acetone | 240 |
| Methanol | 480 |
| Silicon dioxide (average grain size: 1μ) | 0.1 |

A comparative sample was prepared by the method as described in Example 2 of Japanese Patent Application (OPI) No. 7763/80 (corresponding to German Patent Application (OLS) No. 2,926,832). I.e., first, a solution having the formulation shown below was prepared, coated, and dried.

| | Parts by weight |
|---|---|
| 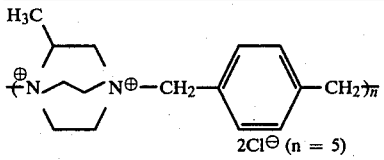 | 8 |
| $H_2O$ | 10 |
| Methanol | 500 |
| Acetone | 300 |

On the thus-prepared layer was coated a dispersion of 10 parts by weight of cellulose diacetate and 0.1 part by weight of fine silicon dioxide particles (average grain size: 1μ) in a mixed solvent of 240 parts by weight of acetone and 480 parts by weight of methanol.

The surface resistance of the thus-obtained film was measured at 25° C. and 25% RH. The results are shown in the Table below.

TABLE

| Sample | Surface Resistance (Ω) Before Development | After Development |
|---|---|---|
| Tin oxide-based fine particle-coated sample (the invention) | $5.0\times10^8$ | $4.8\times10^8$ |
| Comparative sample | $5.1\times10^9$ | $6.3\times10^{12}$ |

As can be seen from the Table above, the surface resistance of the sample with the fine particles of tin oxide-antimony composite oxide coated thereon scarcely changed even after the development processing.

EXAMPLE 3

Using the same electrically conductive fine particles as used in Example 1, a dispersion having the formulation shown below was prepared by shaking for 3 hours by the use of a paint shaker as in Example 1.

| | Parts by weight |
|---|---|
| Electrically conductive fine particles | 200 |
| Cellulose diacetate | 5 |
| Acetone | 150 |

Using the dispersion thus-prepared, a coating solution having the formulation shown below was prepared.

| | Parts by weight |
|---|---|
| Dispersion | 7 |
| Cellulose diacetate | 1 |
| Acetone | 70 |
| Methanol | 30 |

The coating solution was coated on a 135μ thick cellulose triacetate film and dried in a dry coating amount of 1.5 g/m$^2$.

On the thus-prepared layer was coated a solution having the formulation shown below, which was then dried in a dry coating amount of 0.2 g/m$^2$.

| | Parts by weight |
|---|---|
| Cellulose diacetate | 1.5 |
| Acetone | 30 |
| Methanol | 70 |

On the opposite side of the thus-coated layer was coated a subbing layer, and a conventional silver halide color emulsion layer was coated on the subbing layer to prepare a light-sensitive photographic film.

When the back layer of the thus-obtained film was rubbed with a nylon roller at 25° C. and 25% RH, no static marks were formed.

On the other hand, when a sample with no electrically conductive fine particles introduced thereinto was subjected to the same test as above, branch-like static marks were formed.

EXAMPLE 4

A mixture having the formulation shown below was subjected to ultrasonic application for 10 minutes to obtain a homogeneously dispersed solution.

| | Parts by weight |
|---|---|
| Zinc oxide powder | 100 |
| 10% Aqueous solution of $Al(NO_3)_3.9H_2O$ | 5 |
| Water | 100 |

After this dispersed solution was dried at 110° C. for 1 hour, it was sintered at 600° C. for 5 minutes under $1\times10^{-4}$ Torr to obtain electrically conductive zinc oxide powder having a volume resistivity of $2\times10^2$ Ω.cm. The zinc oxide powder was crushed by a ball mill to obtain fine particles having 0.3μ of the average particle size.

A mixture having the formulation shown below was dispersed for 1 hour by a paint shaker to obtain a dispersion.

| | Parts by weight |
|---|---|
| Electrically conductive zinc oxide fine particles | 55 |
| Nitrocellulose | 5 |
| MEK | 320 |

To the resulting dispersion were added 60 parts by weight of acetone and 60 parts by weight of methanol followed by stirring to obtain a coating solution.

The coating solution thus-prepared was coated on a 127μ thick cellulose triacetate film support in an amount of 20 ml/m$^2$, and dried at 120° C. for 10 minutes.

On the thus-prepared layer was further coated a coating solution having a formulation shown below in an amount of 10 ml/m$^2$, and dried.

| | Parts by weight |
|---|---|
| Cellulose diacetate | 1 |
| Acetone | 100 |
| Methanol | 60 |
| Behenic acid amide | 0.01 |

The thus-prepared layer is hereinafter referred to as the back layer.

On the opposite side of the support was coated a conventional silver halide emulsion for microphotography, after first applying a gelatin subbing layer.

The surface resistance of the back layer was $3\times10^{10}$ Ω at 25° C. and 10% RH, with excellent antistatic property.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a plastic support, at least one photographic light-sensitive emulsion layer on one side of the support, and an antistatic layer on the other side of the support, wherein the antistatic layer comprises a binder having dispersed therein fine particles of at least one crystalline metal oxide selected from the group consisting of ZnO, $TiO_2$, $SnO_2$, $Al_2O_3$, $In_2O_3$, $SiO_2$, MgO, BaO, and $MoO_3$, or a composite oxide thereof, said crystalline metal oxide or composite thereof having a volume resistivity of $10^7$ Ω.cm or less, a hydrophobic layer being provided on the antistatic layer, said antistatic layer being between said hydrophobic polymer layer and said support.

2. A photographic light-sensitive material as in claim 1, wherein the metal oxide contains a dopant or oxygen defects.

3. A photographic light-sensitive material as in claim 2, wherein the metal oxide contains a dopant.

4. A photographic light-sensitive material as in claim 3, wherein said metal oxide is ZnO and said dopant is Al or In, said metal oxide is $TiO_2$ and said dopant is Nb or Ta or said metal oxide is $SnO_2$ and said dopant is Sb, Nb, or a hologen element.

5. A photographic light-sensitive material as in claim 3 or 4, wherein the amount of dopant is from 0.01 to 30 mol %.

6. A photogrphic light-sensitive material as in claim 3 or 4, wherein the amount of dopant is from 0.1 to 10 mol %.

7. A photographic light-sensitive material as in claim 1, 2, 3, or 4, wherein the amount of metal oxide particles in the antistatic layer is from 0.05 to 20 g/m$^2$.

8. A photographic light-sensitive material as in claim 1, 2, 3, or 4, wherein the amount of metal oxide particles in the antistatic layer is from 0.1 to 10 g/m$^2$.

9. A photographic light-sensitive material as in claim 5, wherein the amount of metal oxide particles in the antistatic layer is from 0.05 to 20 g/m$^2$.

10. A photographic light-sensitive material as in claim 5, wherein the amount of metal oxide particles in the antistatic layer is from 0.1 to 10 g/m$^2$.

11. A photographic light-sensitive material as in claim 6, wherein the amount of the metal oxide particles is from 0.05 to 20 g/m$^2$.

12. A photographic light-sensitive material as in claim 6, wherein the amount of metal oxide particles in the antistatic layer is from 0.1 to 10 g/m$^2$.

13. The photographic light-sensitive material as in claim 1 wherein said hydrophobic polymer layer is an outer surface layer.

14. The photographic light-sensitive material as in claim 1 wherein the amount of the hydrophobic polymer coated is about 0.05 to 1 g/m$^2$ based on dry weight.

15. The photographic light-sensitive material as claimed in claim 1 wherein the hydrophobic polymer layer is provided by coating a hydrophobic polymer in the form of a solution in an organic solvent or in the form of an aqueous latex.

16. The photographic light-sensitive material as claimed in claim 1 wherein the hydrophobic polymer is a cellulose ester, a vinyl-based polymer, an organic solvent-soluble polyamide or a polyester.

* * * * *